US006322398B1

(12) United States Patent
Fladung

(10) Patent No.: US 6,322,398 B1
(45) Date of Patent: Nov. 27, 2001

(54) PLUG CONNECTOR

(76) Inventor: Manfred Fladung, Heimbach 26, 63776 Mömbris (DE)

( * ) Notice: Subject to any disclaimer, the term of this patent is extended or adjusted under 35 U.S.C. 154(b) by 0 days.

(21) Appl. No.: 09/335,506

(22) Filed: Jun. 18, 1999

(30) Foreign Application Priority Data

Jun. 19, 1998 (DE) ..... 298 11 004 U

(51) Int. Cl.[7] ..... H01R 13/502
(52) U.S. Cl. ..... 439/686; 439/660
(58) Field of Search ..... 439/686, 281, 439/271, 682, 660, 597, 580, 585, 630–640, 650–655

(56) References Cited

U.S. PATENT DOCUMENTS

| | | | | |
|---|---|---|---|---|
| 3,912,889 | | 10/1975 | Bright . | |
| 4,772,231 | * | 9/1988 | Hayes | 439/752 |
| 4,795,366 | | 1/1989 | Tetreault | 439/476 |
| 4,964,815 | | 10/1990 | Kawai et al. | 439/610 |
| 5,542,856 | | 8/1996 | Wood | 439/281 |
| 5,890,930 | | 4/1999 | Gerow | 439/651 |

FOREIGN PATENT DOCUMENTS

| | | | |
|---|---|---|---|
| 3313144 | 10/1984 | (DE) . | |
| 86 064355 | 11/1987 | (DE) . | |
| 4301022 | 7/1994 | (DE) . | |
| 94 111642 | 12/1994 | (DE) . | |
| 19606505 | 9/1996 | (DE) . | |
| 0236923 | 9/1987 | (EP) . | |
| 0362600 | 4/1990 | (EP) . | |
| 655 804 A2 * | 5/1995 | (EP) | H01R/13/523 |

* cited by examiner

*Primary Examiner*—Tulsidas Patel
(74) *Attorney, Agent, or Firm*—Dennison, Scheiner, Schultz & Wakeman

(57) ABSTRACT

The invention relates to a plug connector (10, 106) of an aircraft power supply device for the on-board power supply of aircraft, which comprises a housing (12), whose front element (104) consists of an outer shell body (118) and of an insert (120), which is releasably arranged therein and has hollow-cylindrical receivers (122, 124, 126) for first contact elements.

20 Claims, 7 Drawing Sheets

10
14
16
18
20
22
24
26
28
30
32
34
36
38
48
66
94
96
98
100
110
110

PLUG CONNECTOR

BACKGROUND OF THE INVENTION

The invention relates to a plug connector of an aircraft power supply device for the on-board power supply of aircraft, comprising a housing, which is divided so that it can be separated into at least two sections in the longitudinal direction, of which a first section, constituting the front housing element, has cylindrical first contact elements which, on the receiving side of the plugs, are embodied to be socket- or sleeve-shaped, and can be releasably connected on the side facing away from the plug receptacle with cylindrical second contact elements, such as plug sleeves, which extend from the second section of the housing, which forms the rear element, in which the second contact elements are connected with strands of a cable and encapsulated after having been connected.

Multi-conductor cables with plug connectors are used for the on-board power supply of aircraft, which are seated in a plug receptacle device arranged on board, which contains contact pins. A supply voltage of preferably 220 V, or respectively 112 V/400 Hz, as well as a d.c. voltage (28 V) for acknowledgements, are transmitted via the cables and plug connectors.

The plug connectors of known on-board power supplies respectively have a housing with bores, in which electrically conducting, cylinder-shaped bodies are arranged, which are connected on the inside of the housing with multi-conductor cables, and on their free outer ends are designed as sockets for receiving contact pins. The ends of the supply cables inserted into the plug connectors can be firmly connected with the electrically conducting cylinder-shaped bodies, wherein after assembly the empty space is filled with a sealing compound. In spite of their sturdiness, the housings of the plug connectors are often damaged on their front ends, for example by falling, so that further use is no longer possible. It can also occur that the sockets themselves are damaged. In all these cases the supply cable is cut off closely behind the plug connector in order to then firmly connect the strands with the cylinder-shaped body, embodied with sockets in the front free end of a new plug connector. If such a respective supply cable extends, for example, from a manual control panel, the length of the supply cable provided is normally limited to one to two meters, for example, so that only a limited number of replacements of plugs is possible until further cutting becomes impossible. In this case a new unit must be made available.

In order to supply an aircraft, for example, via the plug connector, the latter is plugged into the plug receptacle with contact pins, which is provided at the aircraft. It should be assured here, that the contact pins are maximally inserted into the sockets in order to assure the required output and signal transmissions through the plug connector to the aircraft. The output transmission, for example, can already take place with little contact. However, spark gaps are often formed, which lead to scorching. Moreover, in case of a fall, the contact pins and/or the sockets can be damaged if the contact pins have been only slightly inserted into the sockets.

If, for example, an aircraft runs over such a plug connector, there is the danger that the rear housing element becomes damaged. The result of this is that the entire plug connector must be replaced, i.e. it must be severed from the supply cable.

Moreover, with the known plug connectors, a step extends between the front element and rear housing element (DE 36 07 753 A1, DE 86 06 435 U1) which, when the plug is run over, can result in the breaking of the housing.

A plug connector of the type mentioned at the outset can be found in EP 0 236 923 B1. In order to make possible a simple change, or respectively replacement of damaged parts in case of damage to the front housing element, or respectively the first contact elements extending therein, it is provided that the first contact elements are releasably arranged in the first housing section. In this way damaged contacts can be replaced in the shortest time and, in particular in case of use at an airport, the damage can be repaired on the spot without having to accept long idle periods.

A corresponding plug can furthermore have a pilot contact for checking whether or not the plug connector has been correctly arranged in a plug receptacle.

Also known is a plug connector with a number of contact sockets arranged in an insulated body and with contact elements designed as a switch, wherein the switch is actuated by a hollow-cylindrical insulated pin projecting from a counter-plug element. The contact elements respectively consist of a conducting pin extending into a hollow cylinder and surrounded by resilient contact fingers. The contact fingers, pre-stressed by a spring, rest against the pin, by means of which a circuit with an indicator device is closed (U.S. Pat. No. 3,912,889).

In connection with otherwise known plug connectors which, however, are not suitable for the on-board power supply of aircraft, the housing can be assembled from half shells, which cannot be cast, and are connected in sections in a kind of groove-and-tongue connection (DE 33 13 144 C2).

The present invention is based on the problem of further developing a plug connector of the type mentioned at the outset in such a way, that damage to the front housing element as well as the rear housing element cannot result in having to replace the plug connector as a whole. In this connection the option of refurbishing housing elements themselves should be provided in particular which, however should be assembled in this way, but wherein heavy loads of, for example 10 t and more, no longer result in damage. It should moreover be assured that the front housing element does not melt in case of extensive heating of the first contact elements, or that, if this should be the case, a complete exchange is not necessary.

In accordance with the invention, the problem is essentially solved in that the front housing element consists of an outer shell body and of an insert, which is releasably arranged therein and has hollow-cylindrical receivers for the first contact elements. In this case the contact elements extend at least partially spaced apart from the hollow-cylindrical receiver receiving the contact element.

By means of the respective construction it is assured that cooling to the required extent can take place in the area of the first contact elements, which assures that, even if too powerful a current flows through the first contact elements, i.e. when a strong contact resistance is built up, melting of the front housing element does not occur because of the heating connected with this. It has been provided here in particular that the insert is made of a plastic material which is temperature-resistant to at 230° C. Granamid or Stanyl®, for example, can be used as the material.

But if melting should nevertheless occur because of the development of too high heat, only the receiver is affected by this, so that it would have to be replaced, while the outer shell body can be further used.

In accordance with a further development of the invention, the hollow-cylindrical receivers themselves are connected, spaced apart from each other, by strips. The insert should also be supported on the shell body by protrusions extending from the insert, such as strips extending in the longitudinal direction of the insert. The necessary "ventilation" of the front housing element is provided by means of this.

In accordance with a preferred embodiment of the invention, the shell body has protrusions, such as longitudinal strips, extending away from the exterior, whose outer surfaces extend flush in respect to the exterior of the rear housing element. It is assured by this that no step is formed between the front and rear housing elements, so that therefore a breaking of the plug connector is prevented if it is run over.

At least one switch element can extend in a known manner from the rear housing element, but in accordance with the invention this is fastened to a support plate which can be fixed in place in grooves in the half shells of the rear housing element which make a transition into each other, wherein the plate with the connecting line leading to the switch element is encapsulated together with the strands of the cable. This results in the advantage that during the exchange of the rear housing element a fresh connection of the switch element with signal lines is not required. Appropriate switches are required, for example for actuating cable rollers, or respectively to connect signal lines, or respectively to disconnected them.

In accordance with an original proposal for a solution it is proposed that the rear housing element consists of two half shells with longitudinal edges, which rest on each other and extend in the longitudinal direction of the housing, that, with the rear housing element assembled, the longitudinal edges form a labyrinth seal, and that the rear housing element is closed at the end toward the front housing element by means of an insert, through which the second contact elements extend, and which itself is sealed at the inside of the housing against the rear housing element by means of a labyrinth seal.

In contrast to the known prior art, the rear housing element is composed of half shells, which rest on each other in the longitudinal direction of the housing and are connected with each other. Here, the longitudinal edges are designed in such a way that, with the half shells assembled, a labyrinth seal is provided. This results in the advantage that shearing of the longitudinal edges is prevented when the rear housing element is placed under a load. In this connection it has been shown that weights of 10 t or more can act on the housing without there being a danger of damage.

Moreover, the labyrinth seal has the advantage that sealing compound cannot escape out of the sides when the rear housing element is filled with it. Therefore the housing elements cannot stick together in the areas of the seams between the housing elements. This means in turn that in case one housing half shell is damaged, the latter can be removed from the other half shell without problems in order to be replaced by a new one. In accordance with a further development of the invention, the half shells should be identically embodied in this case.

It has been provided in particular, that one of the longitudinal edges of the half shell has a strip-like longitudinal protrusion, and the other longitudinal edge has a depression, such as a groove, corresponding to the course of the strip-like longitudinal edge. In this way the half shells are connected with each other in a kind of a groove-and-tongue connection when the rear housing elements are assembled.

In a supplemental way it is possible to insert a sealing element, such as a toroidal cord, into the depression, such as a groove, wherein it is additionally assured that in the course of filling the rear housing element with sealer, the sealing compound cannot escape through the labyrinth seal.

In accordance with the invention, the rear housing element is closed at the side of the housing front end by an insert, through which second contact elements protrude. Here, the insert is sealed on the inside of the housing by means of a labyrinth seal against the rear housing element, or respectively its half shells. It has been provided in particular that the plate-shaped insert has at least one circumferential strip-like protrusion extending in the direction toward the inner housing shell wall, to which a corresponding depression, such as a groove, in the inner housing walls is assigned. However, preferably the insert should have two strip-like protrusions extending parallel in respect to each other, and the inner housing walls should have correspondingly matched, or respectively arranged, depressions, such as grooves. It is possible in this case to arrange a sealing element, such as a toroidal cord, in at least one of the depressions, such as grooves. It is also not necessary that a corresponding strip-like protrusion of the plate-shaped insert engages each one of the grooves circulating in the assembled rear housing element. Instead, it is sufficient if an appropriate strip of the insert is inserted only into the groove extending in the front housing element.

Not only is an assembly aid for aligning the second contact elements on the first provided by the use of the insert, but sealing of the rear housing element when the sealing compound is applied takes place in addition. Moreover, the rear housing element is provided with great sturdiness in its front area.

In a further development of the invention, which should be stressed in particular, the inner wall surfaces of the half shell extend in the form of a cone toward each other in the direction of their respective longitudinal edges. Accordingly, each half shell encloses a hollow space in the shape of a truncated pyramid, which provides the advantage that the half shells can be removed without problems after the setting of the sealing compound and, if necessary, can be replaced by new ones.

In order to make a pouring aid for the sealing compound available, the rear housing end should have an opening widened in the shape of a trumpet, through which the cables also extend.

SUMMARY OF THE INVENTION

A plug connector of the previously described type, wherein a pilot contact, comprising a switch element, such as a microswitch, is arranged in the front housing element, is distinguished in accordance with a proposal which has separate patent protection, in that a sleeve-like first body, through which the rear housing element and the insert extend, is connected, such as screwed together, with a second sleeve-like body, which is releasably arranged in the front housing element, and encloses the end of it, that an end of the first body, which extends inside the second body, is an abutment for a spring element, which directly or indirectly supports the switch element via a first disk element, which can be axially displaced in the first body, and that an actuating element, such as a plunger, of the switch element extends through a second disk element arranged in the second body as a guide, wherein the actuating element extends in the direction toward the opening at the plug receptacle.

A simple embodiment of the pilot contact results from this construction, which can be replaced without difficulties in case of damage. By means of the selection of the thickness of the disk element on which the spring element, such as a helical spring, is supported, it is furthermore possible to adjust the prestress of the spring on the contact element, so that a problem-free adaptation to individual requirements is provided.

A plug connector for the on-board power supply of aircraft: is made available by the teaching in accordance with the invention, which is modularly constructed in such a way that in case of damage to one element, the others can again be easily further used. If, for example, the shell of the front housing element is damaged, it is possible to use the insert, as well as the first contact elements, as well as the rear housing element of the plug connector, again. If a shell of the rear housing element is damaged, all other elements can again be used. Thus, the reuse of more than 50% of the elements of a plug connector designed in accordance with the invention results. Accordingly, wear elements can be replaced without problems, without it being necessary to make available an entire new plug connector, together with the cables leading to it. Thus, a replacement is possible in an extremely short time.

Further details, advantages and characteristics of the invention ensue not only from the claims, the steps which can be taken from them—by themselves alone and/or in combination—, but also from the following description of a preferred exemplary embodiment represented in the drawings.

Shown are in:

DETAILED DESCRIPTION OF THE INVENTION

Figure 1:
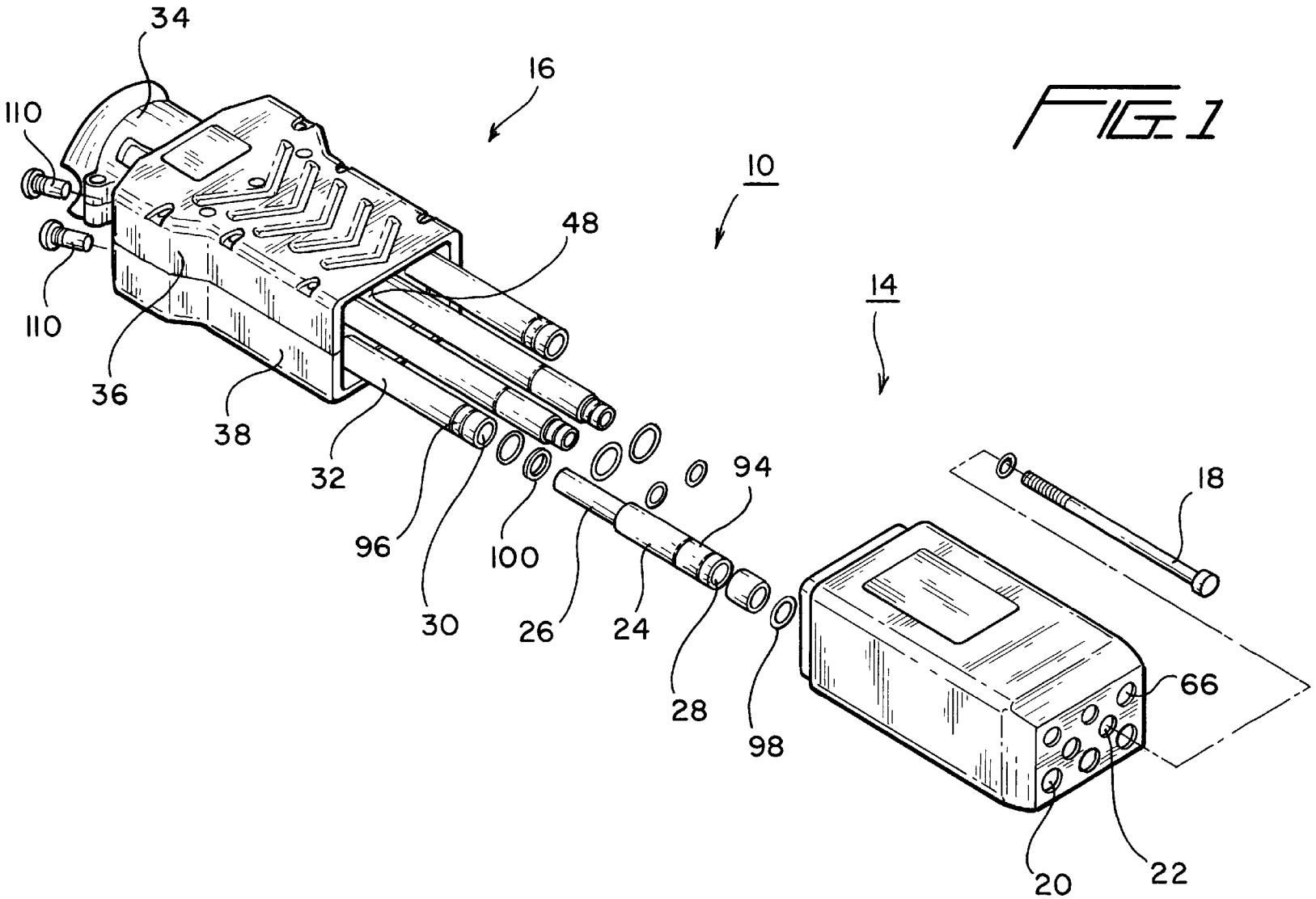
FIG. 1, an exploded view of a first embodiment of a plug connector.
Figure 3:
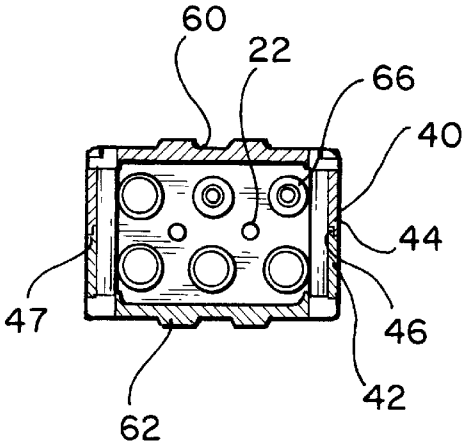

Preferred embodiments of plug connectors intended for aircraft on-board power supply devices, which are particularly intended for a 28 V=/200 V, or respectively 112 V/400 Hz on-board power supply of aircraft, are represented in the drawing figures, in which like elements have in principle been identified by like reference numerals.

A first embodiment of a plug connector 10 in accordance with the invention can be found in FIGS. 1 to 4. The plug connector 10, also called a plug, has a housing 12, which is composed of a first section in the form of a front housing element 14, and a second section in the form of a rear housing element 1E. The housing elements 14, 16 are releasably connected with each other, for example by means of screws 18. To this extent reference is made to a construction as described in EP 0 236 923 B1. Reference is explicitly made to this respective disclosure. This applies in particular also to the contact elements referred to in what follows.

The front housing element 14 has bores 20, 22, into which first contact elements 24 can be inserted on the one hand and, on the other hand, the screws 18 for the releasable connection of the housing elements 14 and 16.

On the inside of the housing the first contact elements 24 are designed as pins 26, and toward the outside as sleeves 28 for receiving contact pins of a plug receptacle.

With the housing elements 14 and 16 combined, the pins 26 of the first contact elements 24 extend inside of sleeve-like receivers 30 of second contact pins 32, which extend from the rear housing element 16 and are connected, such as by crimping, with the strands of a cable, not represented, which extends into the rear housing element 16 from the rear end 34, which is widened in a trumpet shape. To this extent, and as mentioned, reference is made to EP 0 236 923 B1, from which further details regarding the first and second contact elements in particular can be taken.

Figure 5:
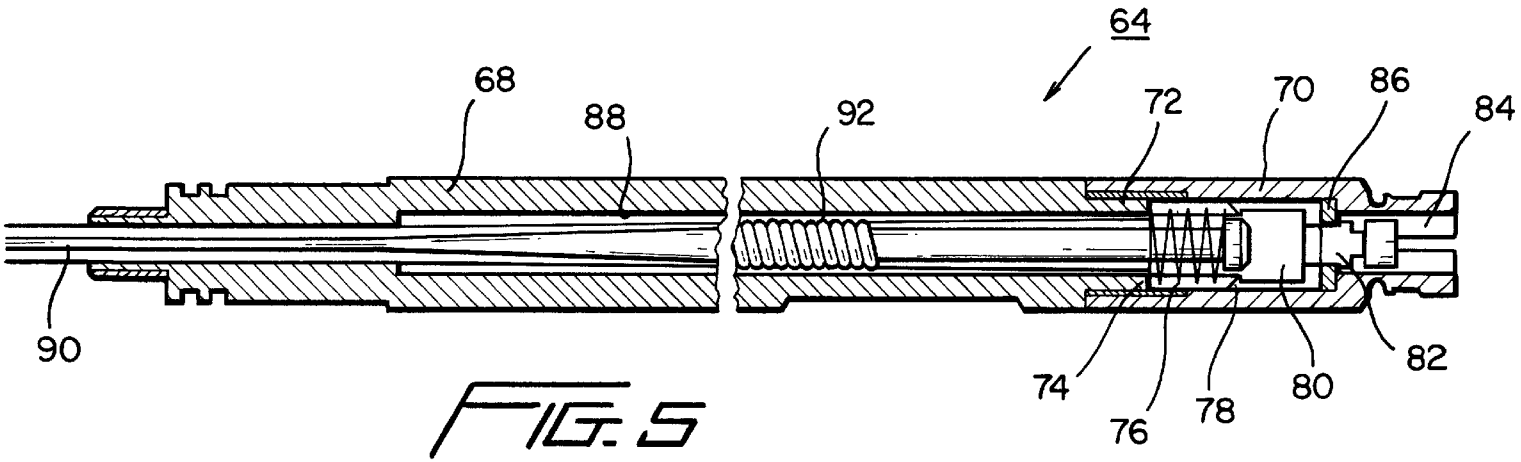
Figure 6:
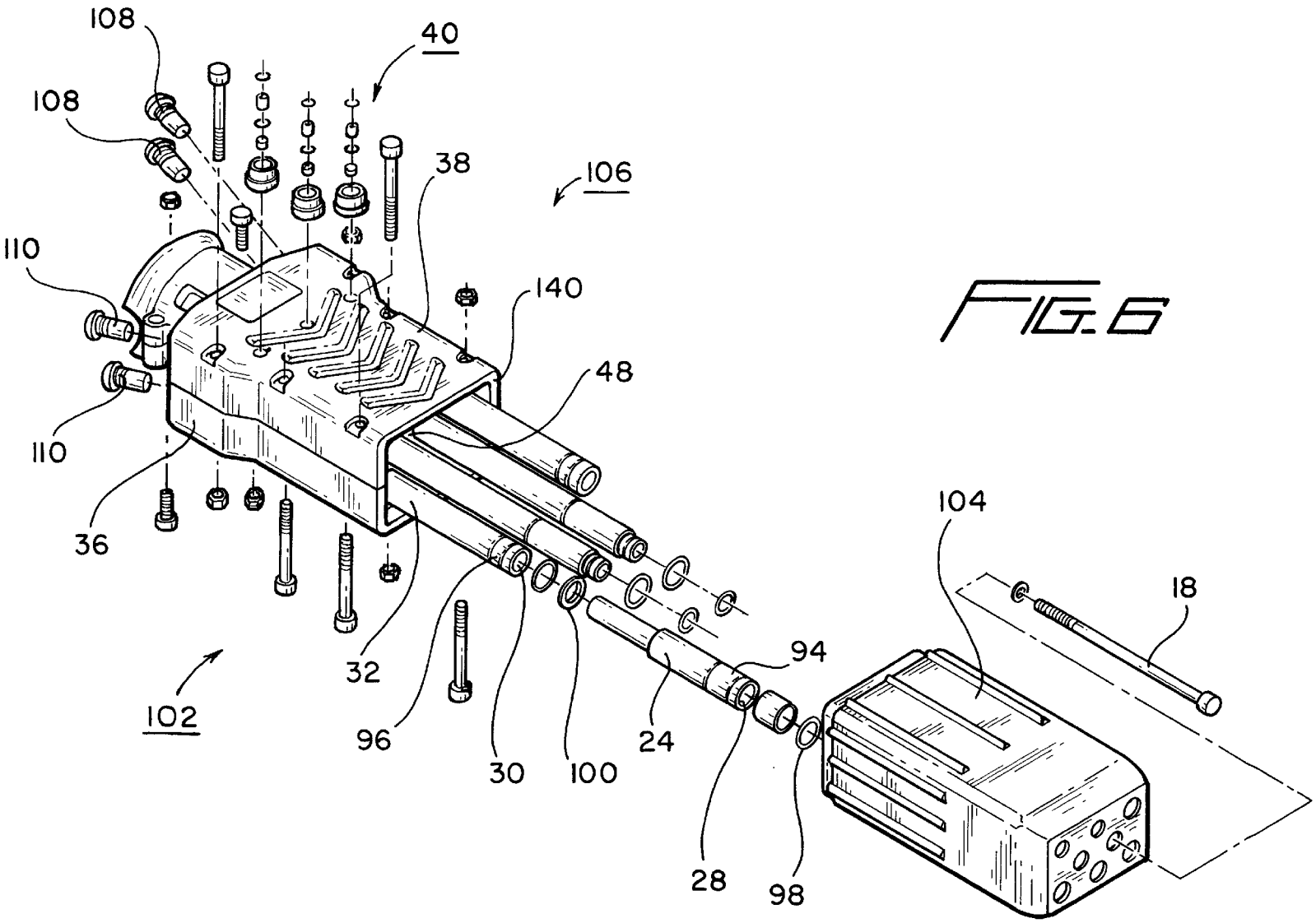
Figure 8:
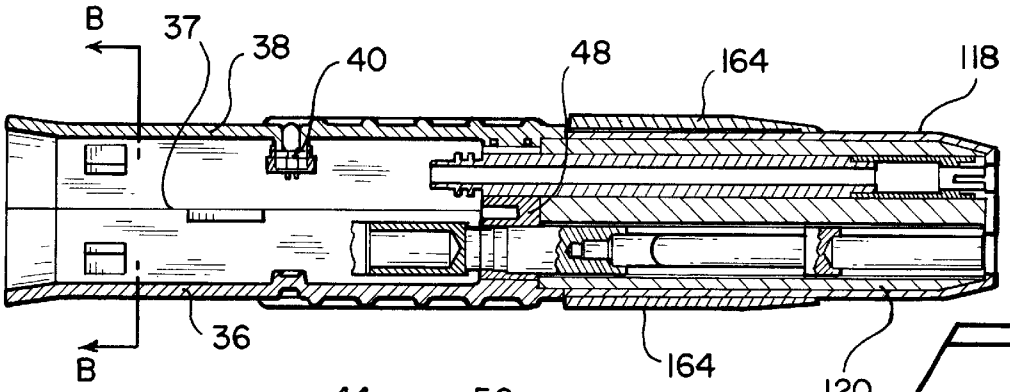
Figure 7:
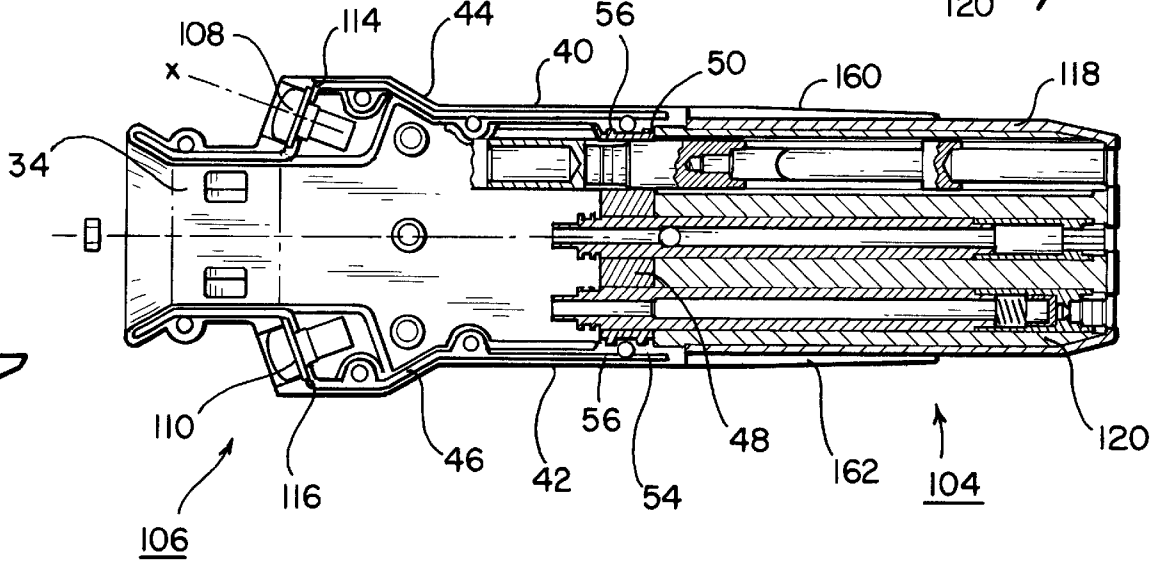
Figure 9:
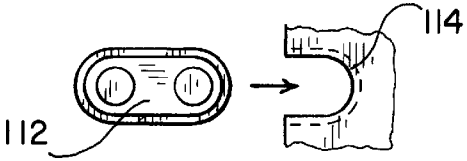

In accordance with the invention it is provided that the rear housing element 16 is assembled from two half shells 36, 38, wherein the separating lines 37 extend in the longitudinal direction of the housing 12, as made clear in the drawing figures. Moreover, the half shells 36, 38 are basically constructed identical in their geometry, wherein one of the half shells 36 can have at least one LED 40, provided the plug connector 10 is equipped with a pilot contact, for example (FIG. 5).

As the view from above on the half shell 38 makes clear, the longitudinal edges 40, 42, which rest on each other when the half shells 36, 38 are assembled, i.e. with the rear housing element 16 closed, are designed in such a way that one of the longitudinal edges, for example the longitudinal edge 42, has a projecting, strip-like longitudinal protrusion 46, to which a corresponding recess, such as the groove 44 in the longitudinal edge 40, is assigned. Thus, with the half shells 36, 38 resting on each other, the protrusion 46 engages the corresponding groove 44 of the other half shell, and vice versa. This results in a groove-and-tongue connection which assures great sturdiness of the assembled rear housing element 16, so that even if the housing 10, in particular the rear element 16, should be run over by a heavy vehicle, shearing of the edges 40, 42 with the result of damage to the half shells 36, 38, cannot occur.

If a groove-and-tongue connection is preferably provided, the longitudinal edges 40, 42 resting on each other can also have other geometries, which offer a labyrinth seal, i.e. not only a centering aid, such as can be provided by plug half shells which, however, do not make available an interlocking connection by the engagement between protrusions and depressions over respectively the entire, or almost entire area of the longitudinal edges.

But the groove-and-tongue connection is not only used for increasing the sturdiness of the assembled half shells 36, 38, as a labyrinth seal it also provides a seal against a sealing compound, with which the rear housing element 16 is filled. In this case the bottom of the groove 46 can have a sealing element, such as a toroidal cord 47, for increasing the sealing effect.

Figure 2:
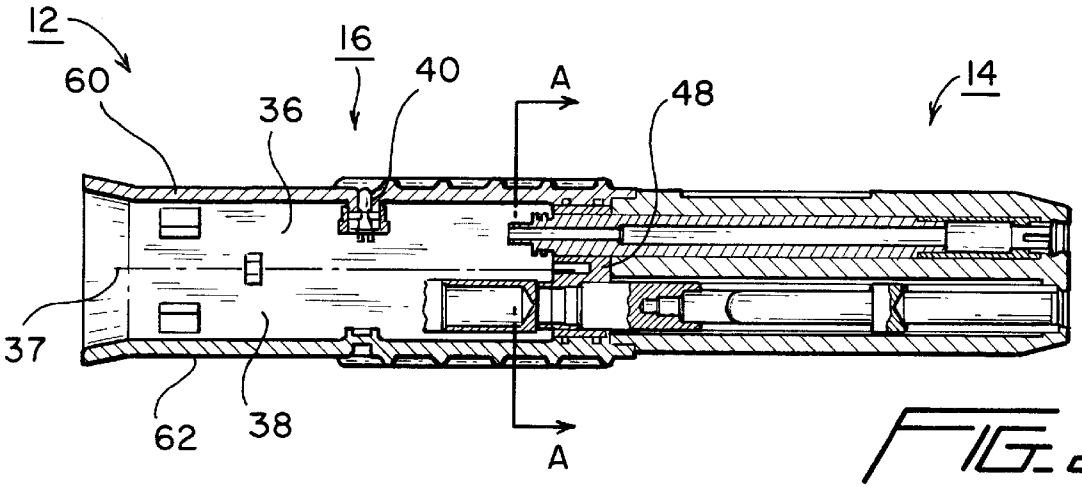
FIG. 2, a cross section through a plug connector corresponding to FIG. 1, FIG. 3, a section along the line A—A in FIG. 2, FIG. 4, a longitudinal section through the plug connector in accordance with FIG. 2, FIG. 5, a longitudinal section through the pilot contact, FIG. 6, an exploded view of a second embodiment of a plug connector, FIG. 7, a section through the plug connector in accordance with FIG. 6 in a plane parallel with the top view, FIG. 8, a section through the plug connector in accordance with FIG. 6 in a plane parallel with the lateral view, FIG. 9, a detail of a holder for a holding element, FIG. 10, a section along the line B—B in FIG. 8 in an extended representation, FIG. 11, a section through a plug front element of a preferred embodiment of a plug connector in accordance with the invention, FIG. 12, a cross section through a front housing element of a plug connector, FIG. 13, a section along the line A—A in FIG. 12, and FIG. 14, a cross section through a further preferred embodiment of a front housing element of a plug connector.
Figure 4:
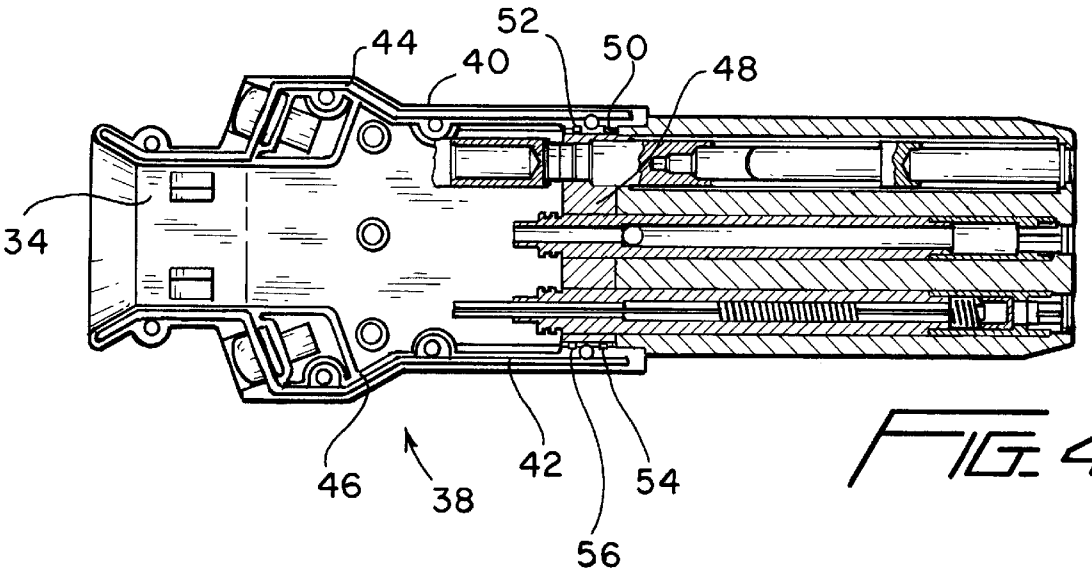

The rear housing element 14 is closed off on the side toward the front housing element by a block- or disk-like insert 48, through which the second contact elements 32 extend, which is made particularly clear in the cross-sectional representations in accordance with FIGS. 2 and 4. To seal the insert 48 against the inner wall surfaces of the housing shells 36, 38, and at the same time to increase the sturdiness of the connection, the insert 48 has at least one circumferential, projecting, strip-like protrusion 50 which, with the housing shells 36, 38 assembled, engages a correspondingly extending and arranged groove-like depression 54 of the housing shell 36, 38. Parallel with the groove 54, but closer toward the end 34 embodied in a trumpet shape, a second groove 54 extends, into which a sealing element, such as a toroidal cord 52, can be inserted. It is also possible to arrange a sealing element, such as a toroidal cord made of foam rubber, in the bottom of the depressions, such as the grooves 54, 56.

The half shells 36, 38 are connected with each other by means of connecting elements, such as screws. The interior of the rear housing element 14 is filled with sealant from the rear, i.e. through the trumpet-like widening 34, so that after the sealing compound has set, a solid rear housing element 16 results, which can absorb strong loads.

To make the exchange of housing shells 36, 38 possible without having to replace the insert 48 with the encapsulated second electrical contacts 32, as well as the strands of the cable, not represented, connected with them, the inner wall surfaces of the housing shells 36, 38 extend toward each other in such a way that they widen conically toward the edge. Therefore the cross section of each housing shell has a trapezoidal shape, whose shorter base lines are constituted by the base surfaces 60, 62 of the housing shells 36, 38. Because of the conicity, the simple removal of the housing shells 36, 38 from the cast block, which encloses the sections of the second electrical contacts 32, as well as the strands of the cable extending inside of the rear housing element 16, is possible.

It should moreover be pointed out, that each of the sleeve-shaped sections 28, 30 of the first and second contacts 24, 32 respectively have a circumferential depression 94, or respectively 96. Furthermore, the sleeve-like sections 28, 30 are slit in the longitudinal direction. In order to make it impossible for the sleeves 28, 30 to spread open, and at the same time to assure that pins 26, which can be inserted into the latter, rest flat against the inner surfaces of the sections 28, 30, annular spring elements 98, 100 are provided in the offset sections 94, 95, which prevent the impermissible spreading of the sleeve-shaped sections 28, 30.

In accordance with the invention a plug 10 results, wherein the elements, which are particularly exposed to wear and the danger of damage, can be replaced without problems; this applies in respect to the half shells 36, 38 of the rear housing element 16, as well to the front housing element 14, as well as the first electrical contacts 26, which are releasably arranged in the latter, in particular by taking into consideration the embodiments of FIGS. 6 to 14, in which basically like reference numerals are used for like elements.

A pilot contact 64 is shown in an enlarged representation in FIG. 5. For this purpose, in a bore 66 a first sleeve-like element 68 is provided, which extends from the insert 48, and is preferably connected by screws with a sleeve-like second element 70, which is releasably arranged in the front housing element 14. In this case the rear, sleeve-like body 68 extends with its front edge area 72 inside the body 70 and with its front face 74 constitutes an abutment for a helical spring element 76, which in turn acts on a disk element 78, which is axially displaceable in the body 70 and supports a microswitch 80. A plunger 82 extends from the microswitch 80 for its actuation, which extends in the direction of the opening 84 on the side of the contact pin of the sleeve-shaped body 70. In this case the plunger 82 extends through a second disk 86, which is used as a guide. Inside the bore 88, which extends through the first sleeve-like body 68 and terminates in the rear housing element 14, cables 90 extend and are connected with the LED 40 in order to signal whether or not the microswitch 80 has been actuated. The former occurs if the plug 10 is correctly connected with a plug receptacle.

As FIG. 5 makes clear, the cable 90 has a spiral section 92, or a section having the same effect, by means of which the advantage is provided that the switch 80 can be replaced because a sufficient amount of cable is available.

The sleeve-like body 68 can consist of plastic and is preferably coated, for example with nickel. The front sleeve-like body 70, into which the contact pins for actuating the switch 78 project, should be made of metal.

A further preferred embodiment of a plug connector 102 is represented in FIGS. 6 to 14 which, with the exception of its front housing element 104, has a basic structure such as described in connection with FIGS. 1 to 5. To this extent reference is made to the respective disclosure. The rear housing element 104 in particular corresponds in its structure, especially in respect to the labyrinth seal in the insert, to that of the rear housing element 106 with the housing shells 36, 38. This is symbolized by means of the identical reference numerals. The same applies in respect to the first and second contact pins 24 and 32, as well as to the pilot contact, not further identified.

Switch elements or keys 108, 110 are also located in the rear housing element 106 and are arranged in a rear area of the rear housing element 106, which extends obliquely in respect to the longitudinal axis. Here, the respective switch elements 108, 110 extend from oval-shaped holding plates 112 which, when the housing shells 36, 38 are assembled, are fixed in place in grooves 114, 116, which transition into each other. In this case the grooves 114, 116 respectively define a plane extending perpendicularly in respect to the plane in which the separating line 37 between the half shells 36, 38 is located. The disk-shaped holders 112 are encapsulated with the sections of the switch elements 108 and 110 extending on the inside of the housing, as well as with the wiring leading to them. When replacing one or both half shells 36, 38, the switch elements 108, 110 with their holders 112 constitute a unit together with the cast block. Elaborate wiring is therefore not necessary when a partial replacement of the rear housing element 106, i.e. of its half shells, is required.

Figure 10:
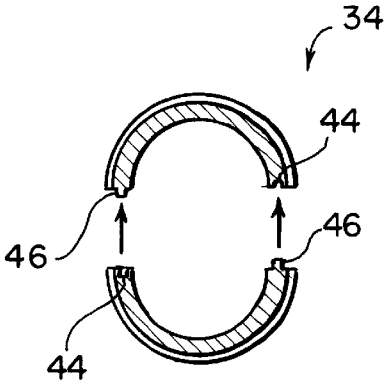

In connection with the sectional representation in FIG. 10 it should be noted that the end 34 of the rear housing element 106, or respectively 16, which is embodied in a trumpet shape, has a circle-, or respectively ellipse-shaped cross section. Furthermore, the projections 46 and grooves 44, which are designed to be congruent with each other and which engage each other when the half shells 36, 38 are assembled, can be seen in the cross-sectional representation in particular.

An important difference between the exemplary embodiment of FIGS. 1 to 4 and the one in FIGS. 6 to 14 rests in the front housing element 104, which consists of an outer shell 118 and an insert 120, which is releasably arranged therein, which itself has hollow-cylinder-shaped receivers 122, 124 for the first contact elements 24, or respectively for pilot contacts, and other elements known in connection with plug connectors. In this case the insert 120, or respectively the hollow-cylindrical or tubeshaped receivers 122, 124 are at least partially spaced apart from the shell 118, which is made clear in particular in the drawing representations of FIGS. 11 to 14. Air cooling is achieved by this, which assures that in case the first contacts 24 are impermissibly heated because of incorrectly inserted contact pins and the strong contact resistance being generated by this, in principle this does not lead to melting of the insert 120, in particular not of the outer shell 118. If the insert 120 should nevertheless melt, it is only necessary to replace it, without it being required to replace the outer shell 118.

In this case the outer shell 119 itself has a cup shape of a rectangular cross section, wherein the front face has the openings for the contact pins, i.e. represents a geometry such as the one made clear by FIG. 1.

The half shells themselves preferably consist of Granamid or Stanyl® and have a temperature resistance of at least 230° C.

Figure 11:
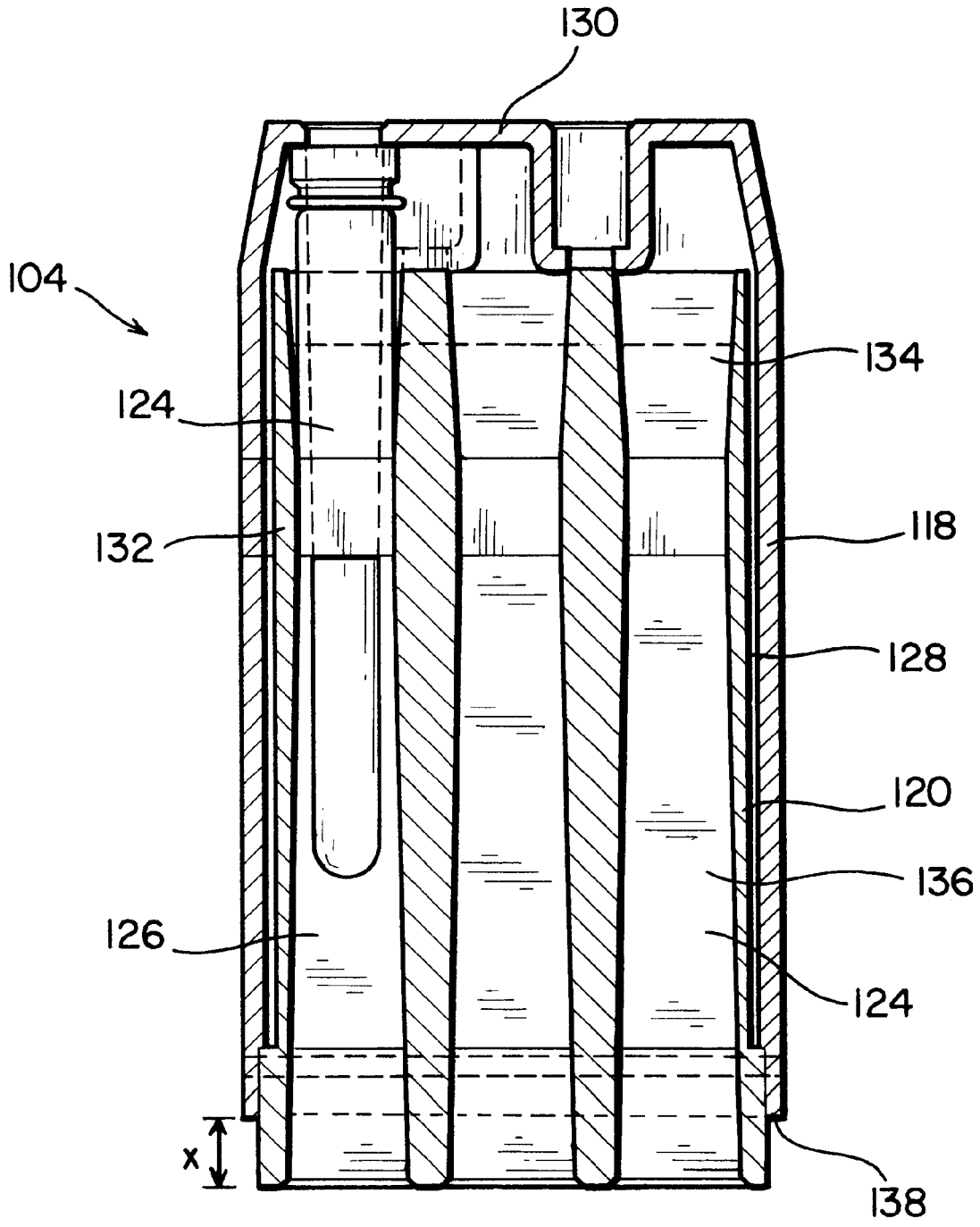

As made clear in particular by means of FIG. 11, the insert 120 extends along the outer surface quite far apart from the inner wall of the outer shell 118. Accordingly, a gap 128 is formed, through which air can flow. Moreover, the tube-shaped elements 126 forming the hollow-cylindrical guides have a double conicity, in that they are conically widened toward the front 130 of the front housing element 104, as well as toward its rear, so that the first contacts 24 are only received by the hollow-cylindrical guides 122, 124, 126 and fittingly fixed in place only in a narrow area 132. In this case the double conicity is asymmetrical, i.e. the area 134 at the front is shorter than the area 136 at the rear. The ratio of the lengths of the areas 134, 136 is approximately 1:3.

Figure 13:
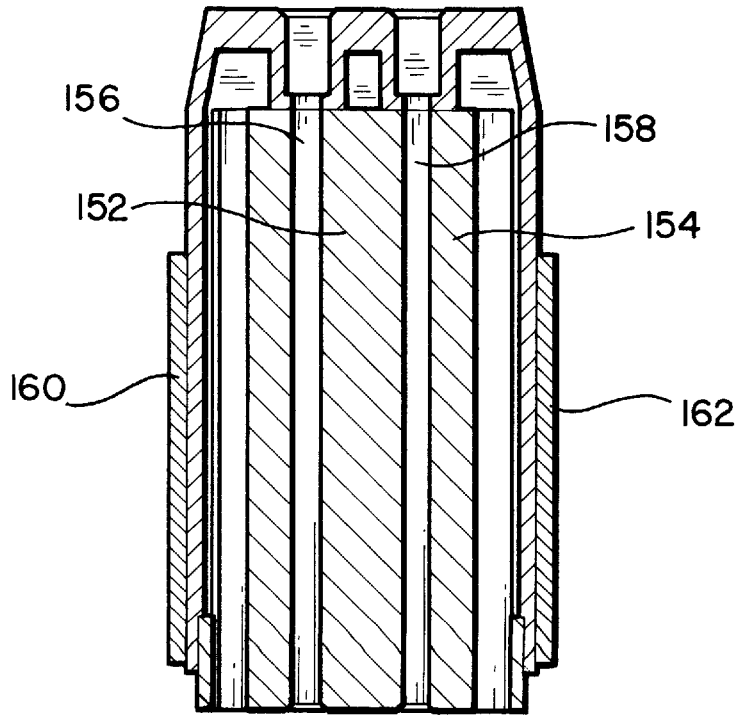

The insert 120 furthermore extends over the rear end 138 of the outer shell 118, as made clear by the sectional representation in FIGS. 11 and 13. In this case the insert 120 projects beyond the outer shell 118 in the back by a value X, which corresponds to the distance between the edge 140 extending on the side toward the front of the housing of the rear housing element 106 and the free outer surface of the insert 48. The front housing element 104 is fixed in place by means of screw elements 18, corresponding to the exemplary embodiment in FIG. 1.

Figure 12:
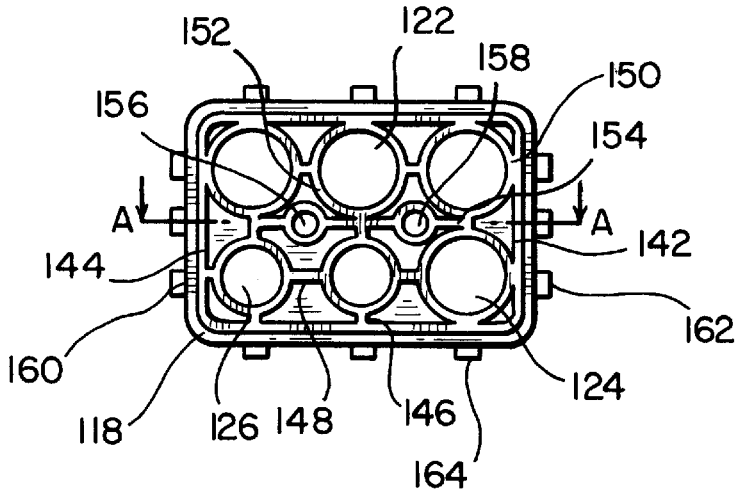

In the exemplary embodiment of FIG. 12, the insert 142 has a circumferential frame 144, whose exterior geometry corresponds to the interior geometry of the outer shell 118. Here, the hollow-cylindrical receiver elements 122, 124, 126 are connected with the frame 144 via strips 146. On their part, the receivers 122, 124, 126 are connected with each other via strips 148, 150. Moreover, central strips 152, 154 have circle-shaped widenings 156, 158, through which the screws 18 extend.

Figure 14:
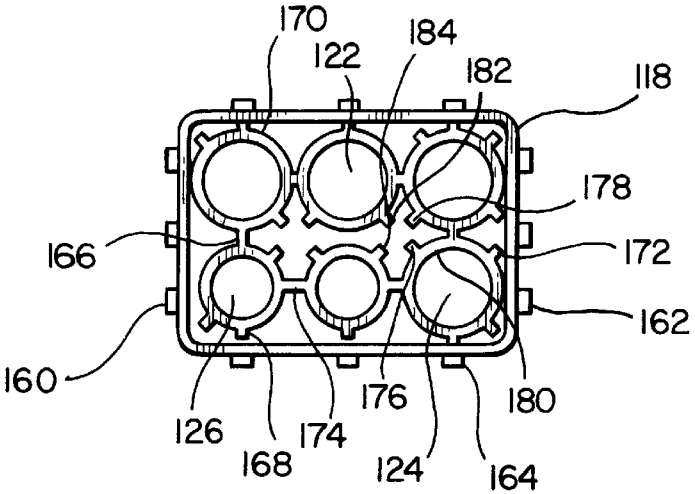

However, preferably an insert 166, which can be seen in FIG. 14, extends in the outer shell 118, which can be supported via longitudinal strips or ribs 168, 170, 172 on the inner wall of the outer shell 118, wherein the hollow-cylindrical tube elements 122, 124, 126 are connected with each other via strips 170, 172. Strips 178, 180, 182, 184 also project away from the facing surfaces of the hollow-cylinarical guides 122, 124, 126, which delimit a guide for the screw 118.

The outer shell 118 is provided with longitudinal ribs, whose outer surface extends flush with the outer surface of the rear housing element 106. In this way and differing from the known plug connectors, no step is formed between the rear housing element 106 and the front housing element 104, which otherwise could lead to rupture when the plug connector 102 is run over.

What is claimed is:

1. A plug connector (10, 106) of an aircraft power supply device for the on-board power supply of aircraft, comprising a housing (12), divided so that it can be separated into at least a first section (14, 104) and a second section (16, 106) in a longitudinal direction, said first section, constituting a front housing element (14, 104), having cylindrical first contact elements (24) releasably connectable with cylindrical second contact elements (32), extending from the second section (16, 106) of the housing, said second section forming a rear element, wherein the second contact elements are connected with strands of a cable and encapsulated after having been connected, wherein the front housing element (104) comprises an outer shell body (118) and an insert (120) releasably arranged therein, said insert further comprising a plurality of hollow-cylindrical receivers (122, 124, 126) for said first contact elements (24) substantially separated from each other and said housing by at least one air gap.

2. The plug connector in accordance with claim 1, wherein a portion the first contact element (24) is spaced apart from the hollow-cylindrical receiver (122, 124, 126) receiving the first contact element (24).

3. The plug connector in accordance with claim 1, wherein the hollow-cylindrical receivers (122, 124, 126) are connected, spaced apart from each other, by strips (174, 176).

4. The plug connector in accordance with claim 1, wherein the insert (166) is supported on the shell body (119) by protrusions extending from the insert in the longitudinal direction of the insert.

5. The plug connector in accordance with claim 1, wherein the shell body (118) has protrusions extending away from the exterior, said protrusions having outer surfaces extending flush in respect to the exterior of the rear housing element (106).

6. A plug connector (10, 106) of an aircraft power supply device for the on-board power supply of aircraft, comprising a housing (12), divided so that it can be separated into at least a first section (14, 104) and a second section (16, 106) in a longitudinal direction, said first section, constituting a front housing element (14, 104), having cylindrical first contact elements 24 releasably connectable with cylindrical second contact elements (32), extending from the second section (16, 106) of the housing, said second section forming a rear element, wherein the second contact elements are connected with strands of a cable and encapsulated after having been connected, characterized in that the front housing element (104) comprises an outer shell body (118) and a first insert (120) releasably arranged therein and having hollow-cylindrical receivers (122, 124, 126) for said first contact elements (24) wherein the rear housing element (16) comprises two half shells (36, 38) with longitudinal edges (40, 42), which rest on each other and extend in the longitudinal direction of the housing (12), such that, with the rear housing element assembled, the longitudinal edges form a first labyrinth seal, and such that the rear housing element is closed at the end toward the front housing element by means of a second insert (48), through which second contact elements (32) extend, said second insert being sealed at the inside of the housing against the rear housing element (16) by means of a second labyrinth seal.

7. The plug connector in accordance with claim 6, wherein the half shells are embodied to be identical or essentially identical.

8. The plug connector in accordance with claim 6, wherein one of the longitudinal edges (40) has a strip-like longitudinal protrusion (46), and the other longitudinal edge (42) of the half shell (36, 38) has a depression corresponding to the course of the strip-like protrusion.

9. The plug connector in accordance with claim 6, wherein at least one switch element (108, 110) is provided in the rear housing element (106), which extends from a support plate (112), which can be fixed in place in grooves (114, 116) in the half shells (36, 38) of the rear housing element.

10. The plug connector in accordance with claim 6, wherein the second insert (48) is embodied to be plate-shaped and has at least one circumferential strip-like protrusion (50, 52), which extends in the direction toward the inner wall of the housing shell and to which a corresponding depression in the inner walls of the housing shell, is assigned.

11. The plug connector in accordance with claim 6, wherein the second insert (48) has two strip-like protrusions (50, 52) extending parallel in respect to each other, and the inner walls of the housing have correspondingly matched, or respectively arranged depressions.

12. The plug connector in accordance with claim 10, wherein a toroidal cord is arranged in the depression (46, 54, 56).

13. The plug connector in accordance with claim 6, wherein in the direction of their respective longitudinal edges (40, 42) the inner surfaces of the half shells extend in a cone shaped toward each other.

14. The plug connector in accordance with claim 13, wherein the half shells (36, 38) have trapezoidal cross section at least on the inside.

15. The plug connector in accordance with claim 6, wherein that on the end the rear housing element (16) has an opening (36), which is widened in a trumpet shape, through which the cable extends on the one hand and which, on the other, constitutes a pouring aid for the sealing compound.

16. The plug connector in accordance with claim 6, wherein the half shells (36, 38) of the rear housing element (16) are connected via a groove-and-tongue connection (44, 46) with each other.

17. The plug connector in accordance with claim 1, wherein the first contact elements (24) are removably arranged in bores of the front housing element (14).

18. The plug connector of claim 1 wherein the front housing element (14) has a pilot contact, comprising a switch element (80), wherein a sleeve-like first body (68), through which the rear housing element (16) and the insert extend (48), is connected, with a second sleeve-like body (70), which is releasably arranged in the front housing element (14) and encloses the end of it, that an end of the first body, which extends inside the second body, is an abutment for a spring element (76), which directly or indirectly supports the switch element (80) via a first disk element (78), which can be axially displaced in the first body, and that an actuating element of the switch element (80) extends through a second disk element (86) arranged in the second body as a guide, wherein the actuating element extends in the direction toward the opening (94) at the plug receptacle.

19. The plug connector in accordance with claim 18, wherein the first body (68) has a through-bore (88), through which a cable (88), which has at least one spiral section, extends and which itself leads to an indicator element arranged in a bottom wall (60) of one housing shell (36) of the rear housing element (16).

20. A plug connector of an aircraft power supply device for the on-board power supply of aircraft, comprising a housing divided into first and second sections in a longitudinal direction, the first section comprising a front part of the housing and said second section comprising a rear part of the housing, said front part having cylindrical first contact elements releasably connectable to cylindrical second contact elements extending from the rear part of the housing wherein the front part of the housing includes an outer shell body and an insert extending within the outer shell body and releasably arranged therein, the insert having hollow-cylinder receivers for the first contact elements, the hollow cylindrical receivers extending within the insert, and being connected and spaced apart from each other by strips.

* * * * *